US007073360B2

(12) United States Patent
Johansson et al.

(10) Patent No.: US 7,073,360 B2
(45) Date of Patent: Jul. 11, 2006

(54) LOCK CYLINDER

(75) Inventors: Henric Johansson, Husby-Rekarne (SE); Torsten Johansson, Eskilstuna (SE); Claes Magnusson, Värmdö (SE)

(73) Assignee: SOUTHCO, Inc., Concordville, PA (US)

( * ) Notice: Subject to any disclaimer, the term of this patent is extended or adjusted under 35 U.S.C. 154(b) by 0 days.

(21) Appl. No.: 11/108,488

(22) Filed: Apr. 18, 2005

(65) Prior Publication Data

US 2005/0235713 A1 Oct. 27, 2005

Related U.S. Application Data

(60) Provisional application No. 60/562,807, filed on Apr. 16, 2004.

(51) Int. Cl.
*E05B 35/08* (2006.01)

(52) U.S. Cl. ..... 70/337; 70/338; 70/341; 70/380

(58) Field of Classification Search ..... 70/336–343, 70/393–400, 375, 406–407, 409, 420–421, 70/423, 453–454, 424, 427–428, 455
See application file for complete search history.

(56) References Cited

U.S. PATENT DOCUMENTS 1,850,586 A * 3/1932 Heyer ..... 70/338
2,197,673 A * 4/1940 Albertz ..... 70/395
3,210,973 A * 10/1965 Basseches ..... 70/383
3,257,831 A * 6/1966 Schlage ..... 70/383
4,912,953 A * 4/1990 Wobig ..... 70/383
6,477,875 B1 * 11/2002 Field et al. ..... 70/491

OTHER PUBLICATIONS

Photograph of Kale Kilit Key, (fiam barel) KOD:164 F.3 2 pages.
Web Page http://www.globelock.com.tw/point-05.htm, Mar. 11, 2004 1 page.
Web Page http://www.globelock.com.tw/p0600-06.htm, Mar. 11, 2004 1 page.
Web Page http://www.aniki-1975.com/cgi-bin/getprod?home=aniki&prodid=p024&lang=, Mar. 11, 2004 1 page.
Web Page http://www.aniki-1975.com/cgi-bin/getprod?home=aniki&prodid=p010&lang=, Mar. 11, 2004 1 page.
Web Page http://www.batonlockusa.com/key.html, Mar. 11, 2004 1 page.

* cited by examiner

*Primary Examiner*—Brian E. Glessner
*Assistant Examiner*—William Schrode
(74) *Attorney, Agent, or Firm*—Paul & Paul

(57) ABSTRACT

A lock cylinder having a master key capability wherein the lock cylinder can be provided with either a master annular ring on the front of the lock plug which can only be opened by a master key or a low level security annular ring which permits the lock cylinder to be opened by either the master key or the low level security key.

7 Claims, 4 Drawing Sheets

LOCK CYLINDER

This application claims the benefit of U.S. Provisional Application 60/562,807 filed Apr. 16, 2004.

BACKGROUND OF THE INVENTION

The present invention relates generally to lock cylinders.

Lock cylinders are known in the art and are provided for the locking and unlocking of a latch to permit the opening and closing of a member such as a door or panel.

Oftentimes it is desired that the lock cylinder have the capability of being opened with a master key in addition to a lower level security key. This is particularly true in the case of marine applications where the individual members of a crew need access to individualized areas which the captain of the vessel also needs access to. However, there may be locked areas which are only to be accessible by the captain of the ship. In such cases, the captain would need a high level security key or master key to access his areas and also the crews areas.

In many prior art lock cylinders, the door or panel in which the lock cylinder was installed needed to be as thick as a significant portion of the length of the key which is inserted into the lock cylinder. This resulted in very long lock cylinders which oftentimes would protrude from the back side of the door or panel due to the length of the lock cylinders. Accordingly, due to space limitations it is desired to have a door or closure member which can accommodate a lock cylinder which is thin or in other words where the length of the axis of the lock cylinder is as short as possible so that the lock cylinder when installed in the door does not protrude from the front or back of the door.

A need therefore exists for a lock cylinder having a master key capability which can be accommodated in doors of a thickness which prior art lock cylinders could not be accommodated in.

The present invention has been developed in view of the foregoing and to overcome the deficiencies of the prior art.

SUMMARY OF THE INVENTION

In accordance with the present invention, it is an object to provide an improved lock cylinder having master key capability which is readily adaptable to different thicknesses of doors or closure members.

Another object of the present invention is to provide a door lock that is easy to operate.

A further object of the invention is to provide a lock cylinder which has a very low profile or thickness and which can be used in applications where space and thickness is a limiting factor.

It is a further object of the invention to provide a lock cylinder which can be fitted with two different annular rings, one of which is designed to operate the lock cylinder with only a master key and another which is to operate the lock cylinder with either a master key or a low level security key.

A further object of this invention is to provide such a lock cylinder with structural components which offers ease of assembly, and reliable operations.

The objects of the present invention are realized in a lock cylinder configured for a key. Master key functionality is attained by adding an annular ring to the basic lock cylinder structure and modifying the profile of the low level security key. A separate key profile for each key is provided to provide the master key capability. A portion of one of the bits of the master key is machined deeper than the low level security key and has a key stop where the bit abuts the stem. When the lock cylinder is provided with a master annular ring, the lock cylinder can only be operated by the master key and not the limited access low level security key due to the presence of a tab on the master annular ring provided on the front of the lock cylinder which prevents entry of the limited access or low level security key into the lock cylinder. The master key can also operate the lock cylinder when the lock cylinder is fitted with a low level security annular ring which does not have the tab which is present on the master annular ring.

BRIEF DESCRIPTION OF THE DRAWINGS

The features, advantages and operation of the present invention will become readily apparent and further understood from a reading of the following detailed description of the invention with the accompanying drawings, in which like numerals refer to like elements, in which.

DETAILED DESCRIPTION OF THE INVENTION

Figure 1:
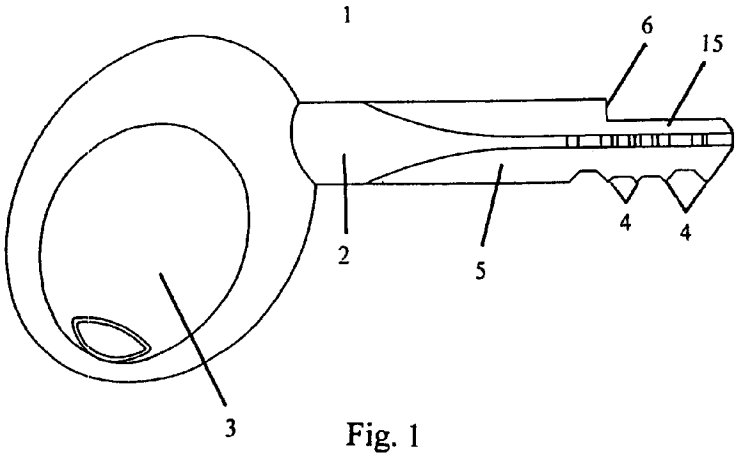
FIG. 1 is a side elevational view of the low level security key of the present invention.
Figure 5:
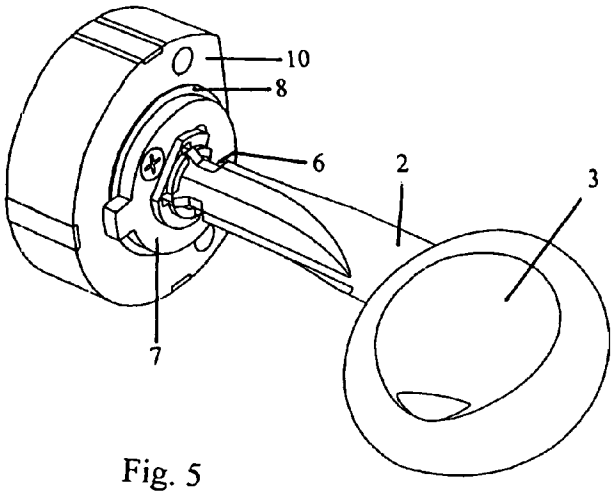
FIG. 5 is a perspective view of the lock cylinder and low level security key of the present invention in a locked state shown with a low level security annular ring.
Figure 7:
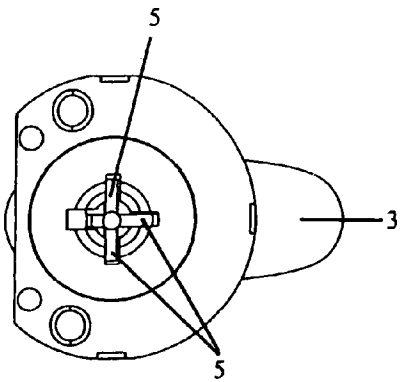
FIG. 7 is a rear elevational view of the lock cylinder and low level security key of the present invention in a locked state shown with a low level security annular ring.
Figure 8:
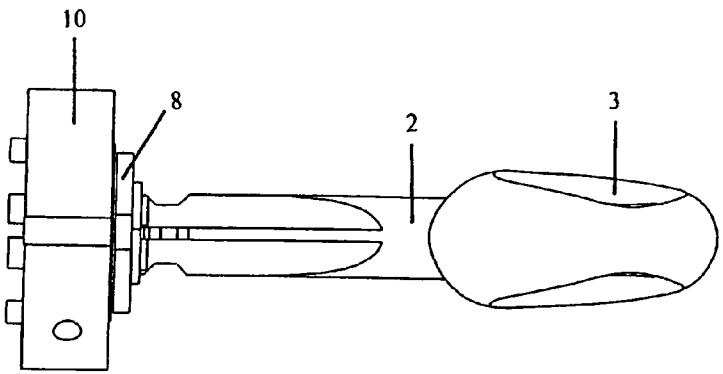
FIG. 8 is a side elevational view of the lock cylinder and low level security key of the present invention in an locked state shown with a low level security annular ring.
Figure 9:
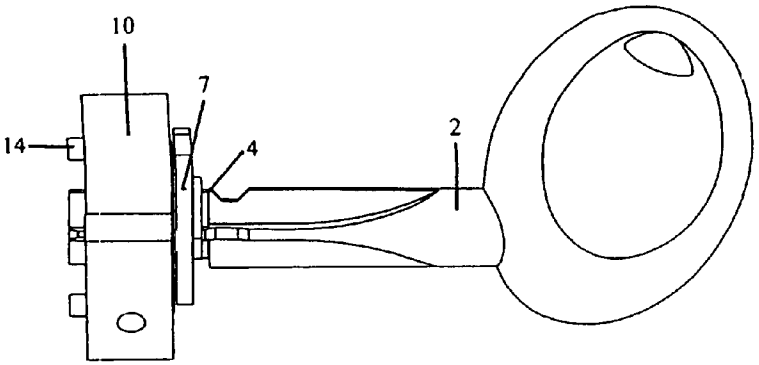
FIG. 9 is a side elevational view of the lock cylinder and low level security key of the present invention in an unlocked state shown with a low level security annular ring.

As seen in FIG. 1, low level security key 1 has grip portion 3 to be held by a user of the low level security key 1 and a stem 2 extending from the grip portion 3. Individual bittings 4 are formed on at least one of the bits of the low level security key 1. Stem 2 of the key 1 which is preferably cylindrical in cross section extends from the grip portion 3 to the bits of the low level security key 1. As shown in this embodiment the low level security key 1, one end of the low level security key 1 is in a star profile as seen in FIG. 7 and has three bitted bits 5. The fourth bit which forms part of the remaining portion of the star profile is the low level security key stop bit 15 which terminates in a low level security key stop 6. Low level security key 1 is dimensioned and configured to be inserted into lock cylinder 13 which has low level security annular ring 7 as seen in FIG. 5 until low level security key stop 6 contacts low level security annular ring 7 which thereby prevents further insertion of low level security key 1 into lock plug 8.

The low level security key stop 6 has a depth equal to the difference between the distance from the top of the low level security key stop bit 15 to the axis of low level security key 1 and the distance from the top of the low level security key stop 6 to the axis of the low level security key, wherein the depth of the low level security key stop 6 is less than the depth of the master key stop 16.

Figure 6:
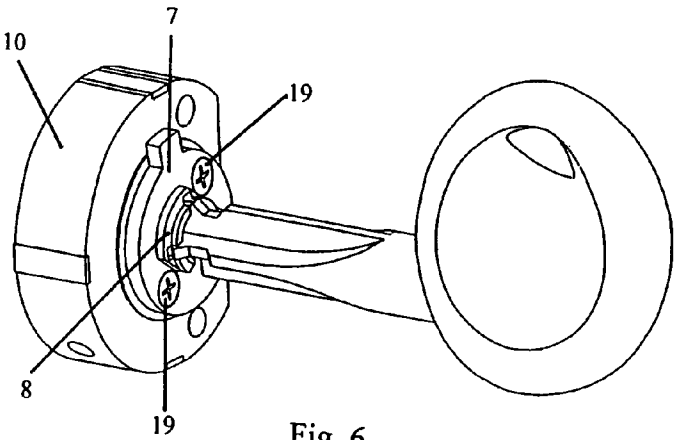
FIG. 6 is a perspective view of the lock cylinder and low level security key of the present invention in an unlocked state shown with a low level security annular ring.

When the lower level security key 1 or master key 12 is inserted, one or more of the bitted bits 5 engage tumblers (not shown) in the lock plug 8 and lock shell 10 which in the locked state extend from lock plug apertures 24 in the lock plug 8 into corresponding lock shell apertures 24 in lock shell 10. After insertion of the low level security key 1, the bitted bits 5 push and align the tumblers which are preferably biased by a biasing means such as a coil spring into positions such that none of the tumblers contacts simultaneously both the lock plug 8 and the lock shell 10 thereby permitting rotation of the lock shell 10 relative to lock plug 8. A user then turns grip portion 3 of the low level security key 1 in a clockwise direction as seen in FIG. 6 to unlock the lock plug 8 from the lock shell 10.

Figure 2:
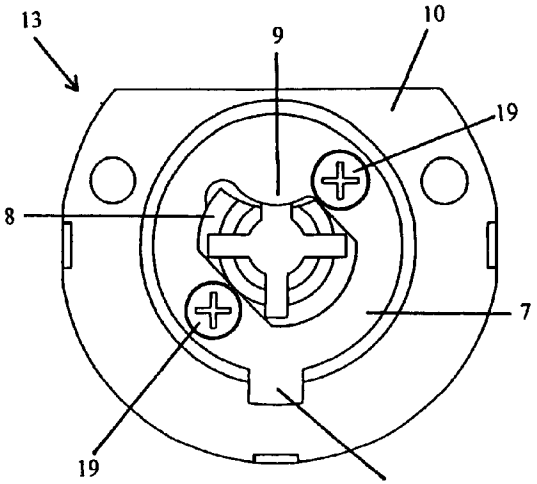
FIG. 2 is a front elevational view of the lock cylinder of the present invention having a low level security annular ring.
Figure 3:
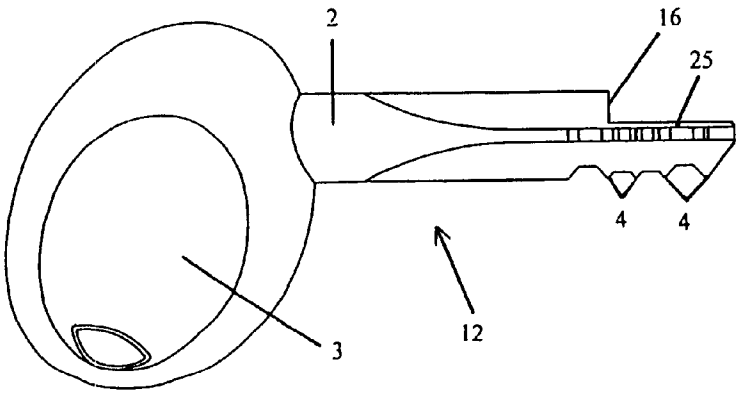
FIG. 3 is a side elevational view of the master key of the present invention.

Lock cylinder 13 of FIG. 2 which is shown with low level security annular ring 7 also accommodates master key 12 of FIG. 3 as the depth of master key stop 16 is sufficiently deep as measured from the top of the master key stop 16 to the top of the master key stop bit 25 to permit passage of the master key 12 into the lock plug 8 until master key stop 16 is prevented from being inserted further into the lock plug 8 by contact with ring stop 9 on low level annular ring 7. The master key stop 16 has a depth equal to the difference between the distance from the top of the master key stop bit 25 to the axis of the master key 12 and the distance from the top of the master key stop 16 to the axis of the master key 12. Therefore, lock cylinder 13 when provided with the low level annular ring 7 can be operated with either the master key 12 or low level security key 1.

Figure 4:
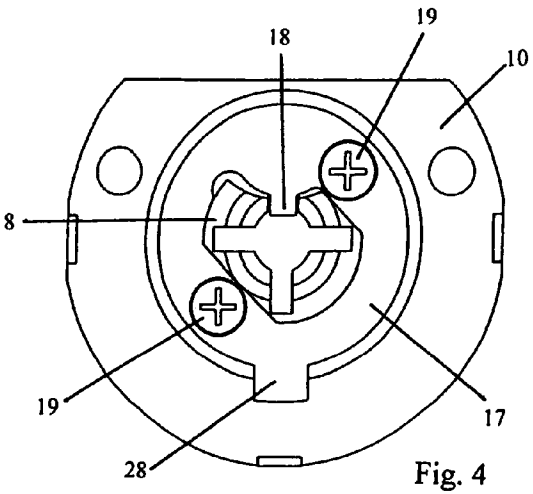
FIG. 4 is a front elevational view of the lock cylinder of the present invention having a master annular ring.

In FIG. 4, the same lock plug 8 and lock shell 10 as seen in FIG. 2 is provided, however a master annular ring 17 is shown screwed to the front of the lock plug 8 by screws 19. The master annular ring 17 is different from the low level annular ring 7 of FIG. 2 in that the master annular ring 17 has a tab 18 which prevents insertion of low level security key 1 into lock plug 8. The low level security key 1 is prevented from being inserted into the lock plug 8 by the contact of low level key stop 6 against tab 18. On the other hand, master key 12 can be inserted into lock plug 8 in FIG. 4 because of the greater depth of master key stop 16 which permits passage of the master key stop bit 25 below tab 18. Accordingly, master key 12 can function as a master key which has the capability of opening both the lock cylinder 13 when it is provided with a low level security annular ring 7 and the lock cylinder 13 when it is provided with a master annular ring 17.

In the same way if a user were to try to insert the low level security key 1 in the lock cylinder 13 while the lock cylinder 13 is fitted with a master annular ring, the bit 15 would be blocked from entering the lock cylinder 13 by tab 18 on the master annular ring 17.

Figure 11:
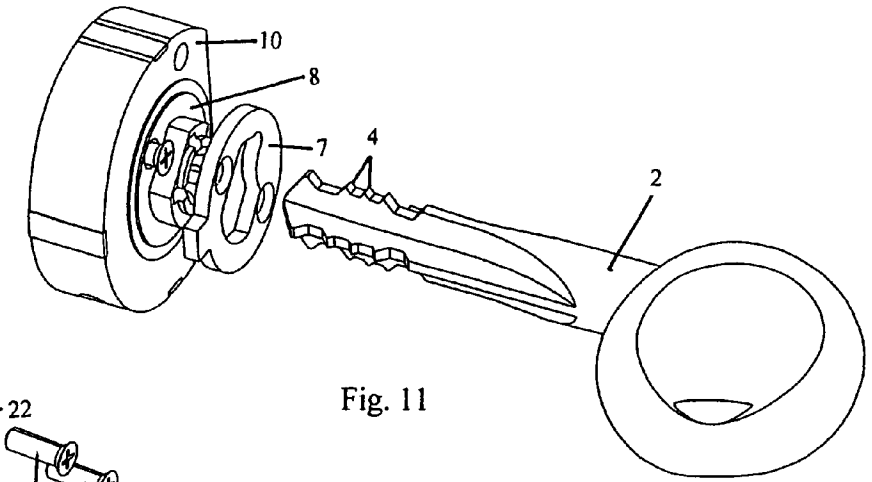
FIG. 11 is an exploded view of the lock cylinder and low level security key of the present invention in a locked state shown with a low level security annular ring.
Figure 10:
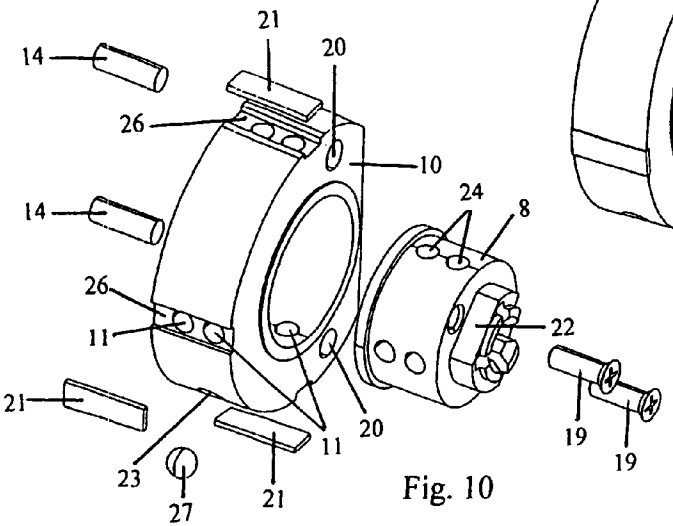
FIG. 10 is an exploded view of the lock cylinder of the present invention without either a master annular ring or a low level security annular ring.

FIGS. 10 and 11 show an exploded view of the lock cylinder 13 of the present invention having shell 10 and lock plug 8. In order to provide for mounting of the lock cylinder 13 in a latch, prongs 14 are provided mounted in an apertures 20 in the lock shell 10. Also, the lock shell 10 is provided with grooves in which plates 21 are fitted to keep biasing means, i.e. coil springs, and tumblers in the lock shell 10 and lock plug 8. Lock plug 8 is also fitted with ring support 22 which serves to maintain the relative position of either the master annular ring 17 or the low level security annular ring 7. In a preferred embodiment, the lock shell 10 is fitted with a ball bearing aperture 23 in which ball bearing 27 is located together with a biasing means (not shown) such as a coil spring. The ball bearing 27 in the ball bearing aperture 23 is biased toward the lock plug 8 which has a detent (not shown) in which a portion of the ball bearing 27 will rest when the lock plug 8 is properly aligned with lock shell 10.

Preferably, the lock plug 8 is located concentric to and rotatable inside of and relative to said lock shell 10, and said lock plug 8 is configured for insertion of said master key 12 or said low level security key 1.

Figure 12:
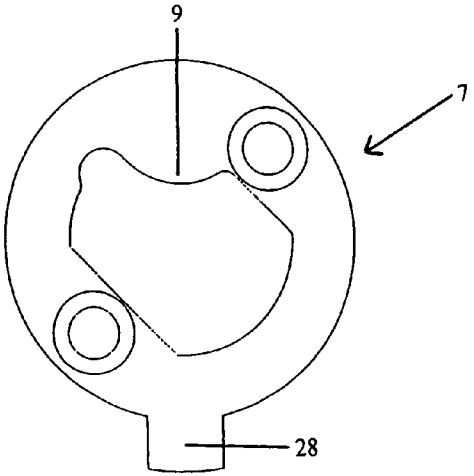
FIG. 12 is a top plan view of the low level security annular ring of the lock cylinder of the present invention.
Figure 13:
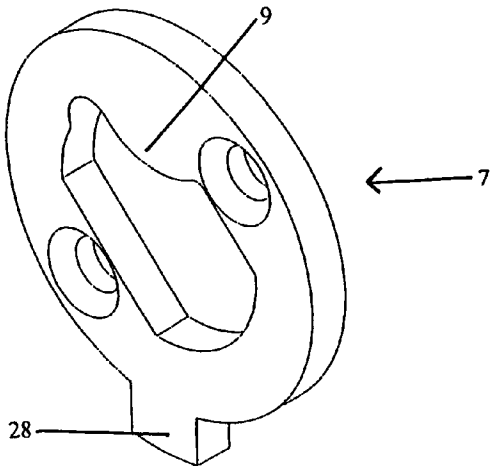
FIG. 13 is a perspective view of the low level security annular ring of the lock cylinder of the present invention.
Figure 14:
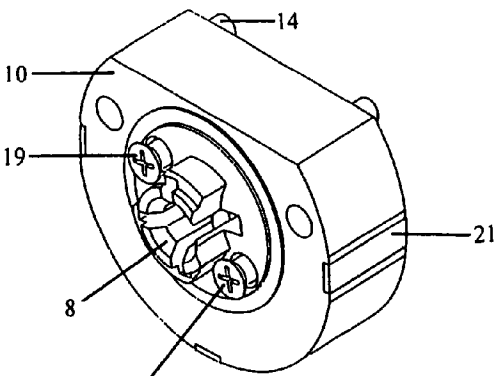
FIG. 14 is a perspective view of the lock cylinder of the present invention shown without a low level security annular ring or a master annular ring.
Figure 15:
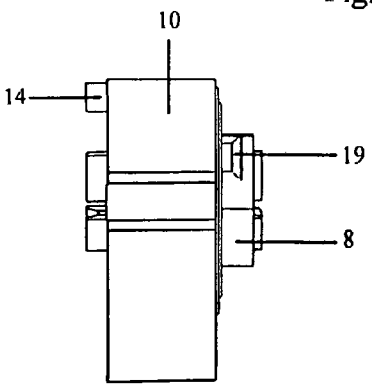
FIG. 15 is a side view of the lock cylinder of the present invention shown without a low level security annular ring or a master annular ring.

Low level security annular ring 7 as shown in FIGS. 12 and 13 has a ring stop 9 which contacts key stop 6 when the low level security key 1 is used and which contacts master key stop 16 when the master key 12 is used. The ring stop 9 can be of any shape which permits insertion of the master key 12 and the low level security key 1 into the lock plug 8 but acts as a stop against a portion of the master key stop 16 or low level security key stop 6 respectively. The tab 18 of the master annular ring 17 can be of any shape, thickness or configuration which permits insertion of the master key 12 up to the master key stop 16 but which does not permit insertion of the low level security key 1 due to contact of the low level security key stop bit 15 against the tab 18.

Tab 18 extends into an interior portion of the ring formed by the master annular ring 17 and the tab 18 permits insertion of the master key stop bit 25 into the lock plug 8 until the master key stop 16 contacts the tab 18 on the master annular ring 17.

Actuator 28 on master annular ring 17 or low level annular ring 7 which are both preferably in the form of a ring actuate the means by which the latch or lock in which the lock cylinder 13 is unlocked when a user unlocks the lock cylinder 13 and rotates either the master key 12 or low level security key 1.

As can be seen by a comparison of FIG. 1 and FIG. 3, a master key and a low level security key can preferably be provided which can have identical bittings on the bits of the two keys. However, when the basic lock cylinder configuration of a lock plug and lock shell is provided with a master annular ring then only the master key can open the lock cylinder. However, the lock cylinder can be opened by a low level security key or master key when the lock cylinder is fitted with the low level security annular ring.

Many changes can be made in the above-described invention without departing from the intent and scope thereof. It is therefore intended that the above description be read in the illustrative sense and not in the limiting sense. Substitutions and changes can be made without departing from the scope and intent of the invention.

We claim:

1. A lock and key combination for providing master key capability comprising:

a) a master key having a first master key bit, a master key stop and a master key stop bit extending along an axis of the master key from the master key stop to a first end of the master key, said master key stop having a depth equal to the difference between the distance from the top of the master key stop bit to the axis of the master key and the distance from the top of the master key stop to the axis of the master key;

b) a low level security key having a first low level security key bit, a low level security key stop and a low level security key stop bit extending along an axis of the low level security key from the low level security key stop to a first end of the low level security key, said low level security key stop having a depth equal to the difference between the distance from the top of the low level security key stop bit to the axis of the low level security key and the distance from the top of the low level security key stop to the axis of the low level security key, wherein the depth of the low level security key stop is less than the depth of the master key stop;

c) a lock cylinder comprising a lock shell and a lock plug, said lock plug being rotatable inside of and relative to said lock shell, and said lock plug being configured for insertion of said master key and said low level security key; and d) a master annular ring, said master annular ring being provided on the lock plug and being nonrotatable relative to the lock plug and said master annular ring being in the form of a ring and being provided with a tab extending into the interior of the ring formed by the master annular ring, said tab permitting insertion of the master key stop bit into the lock plug until the master key stop contacts the tab on the master annular ring and thus permitting rotation of the lock plug from a locked state to an unlocked state, and said tab extending toward the interior of the ring formed by the master annular ring to such an extent that the tab permits insertion of the master key into the lock plug and said tab prevents insertion of the low level security key into the lock plug due to interference of the tab with the low level security key stop bit.

2. The lock and key combination of claim 1 wherein:

the axis along which said first master key bit extends is a longitudinal axis of the master key and said master key further comprises a second master key bit, a third master key bit and a fourth master key bit extending along the longitudinal axis of the master key, and the axis along which said first low level security key bit extends is a longitudinal axis of the low level security key and said low level security key further comprises a second low level security key bit, a third low level security key bit, and a fourth low level security key bit all of which extend along the longitudinal axis of the low level security key.

3. The lock and key combination of claim 2 wherein each of said second low level security key bit, third low level security key bit, and fourth low level security key bit have at least one bitting thereon and each of said second master key bit, third master key bit and fourth master key bit have at least one bitting thereon.

4. The lock and key combination of claim 1 wherein the master annular ring includes a ring stop and the tab on the master annular ring extends from the ring stop to the interior of the ring formed by the master annular ring.

5. The lock and key combination of claim 1 further comprising a means for removably fixing the master annular ring to the lock plug.

6. The lock and key combination of claim 1 wherein a portion of the key has a cross section which is star-shaped.

7. A lock and key system comprising the lock and key combination of claim 1 wherein the master annular ring is removeable from the lock plug, said lock and key system further comprising a low level security ring, said low level security ring capable of being removeably fixed to said lock plug when the master annular ring is removed from the lock plug, and when said low level security ring is fixed to said lock plug said low level security ring permits insertion of said low level security key stop bit of the low level security key and said master key stop bit of the master key into said lock plug such that the lock plug can be rotated with respect to the lock shell.

* * * * *